United States Patent [19]

Dolder

[11] 4,056,907

[45] Nov. 8, 1977

[54] BUILDING BLOCKS AND SUPPORT STRUCTURE

[75] Inventor: Hans Dolder, Kloten, Switzerland

[73] Assignee: Adelheid Dolder, Kloten, Switzerland

[21] Appl. No.: 620,217

[22] Filed: Oct. 6, 1975

Related U.S. Application Data

[63] Continuation of Ser. No. 450,162, March 11, 1974, abandoned.

[51] Int. Cl.[2] ..... F04B 1/00

[52] U.S. Cl. ..... 52/266; 52/270; 52/281; 52/285; 52/479; 52/562; 52/648

[58] Field of Search ..... 52/262, 281, 284, 285, 52/432, 434, 492, 648, 266, 270, 277, 496, 586, 595, 426, 562, 564, 383, 563, 566, 690, 650, 479, 306, 477, 404, 593

[56] References Cited

U.S. PATENT DOCUMENTS

| | | | |
|---|---|---|---|
| 1,420,478 | 6/1922 | Forbush | 52/426 |
| 2,261,510 | 11/1941 | Atcheson | 52/425 X |
| 2,993,409 | 7/1961 | Boyd | 52/306 X |
| 3,336,718 | 8/1967 | Cape | 52/650 |

FOREIGN PATENT DOCUMENTS

| | | | |
|---|---|---|---|
| 526,097 | 6/1956 | Canada | 52/564 |
| 800,990 | 11/1950 | Germany | 52/564 |

*Primary Examiner*—Price C. Faw, Jr.
*Assistant Examiner*—Carl D. Friedman
*Attorney, Agent, or Firm*—Karl W. Flocks

[57] ABSTRACT

A structure composed of a girder grating as well as building blocks retained by such girder grating. The girder grating consists of trusses and the chords of the trusses engage into grooves provided at the building blocks.

15 Claims, 3 Drawing Figures

2
3
4
5
6
7
8
9
10
11
12
13
14
15
16
18
19
20
21

BUILDING BLOCKS AND SUPPORT STRUCTURE

This is a continuation of application Ser. No. 450,162, filed Mar. 11, 1974.

BACKGROUND OF THE INVENTION

The present invention relates to a new and improved structure composed of a girder grating as well as building blocks retained by such girder grating.

Known structure of this type possess a girder grating consisting of profile rods, these profile rods carrying the building blocks which form the actual wall or a ceiling or the like. With such construction of structures only the main supports of the girder grating extend from one support wall to the other and from the floor to a ceiling of a room.

The transversely situated auxilary supports of the girder or support grating can only extend from one main support to the neighboring one if the main support should not be interrupted. Consequently, the individual sections of the auxiliary support must then be connected at the erection site with the main supports by means of for instance screws or the like. Firstly, this work requires a great amount of time and secondly it can only oftentimes by carried out with difficulty, if for instance a girder or support grating is to be mounted for a ceiling or a roof.

Such type structures additionally possess unsatisfactory thermal- and sound insulating properties since the building blocks are only assembled in one layer. If it is advantageously desired to resort to the use of an air layer between two walls with such type structure, then it is necessary to mount two such walls parallel to one another and to insure for the required spacing between such walls.

The expenditure for the construction of such type structure would then be at least twice as much.

SUMMARY OF THE INVENTION

Hence it is a primary object of the present invention to provide an improved structure of the previously mentioned type which is not associated with the aforementioned drawbacks and limitations of the prior art proposals.

Another object of the present invention is directed to the provision of an improved structure of the previously mentioned type which overcomes the aforementioned drawbacks of the prior art proposals.

Now in order to implement these and still further objects of the invention which will become more readily apparent as the description proceeds, the structure of this invention contemplates that the girder or support grating consists of trusses and that the chords of the trusses engage into grooves provided at the building blocks.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
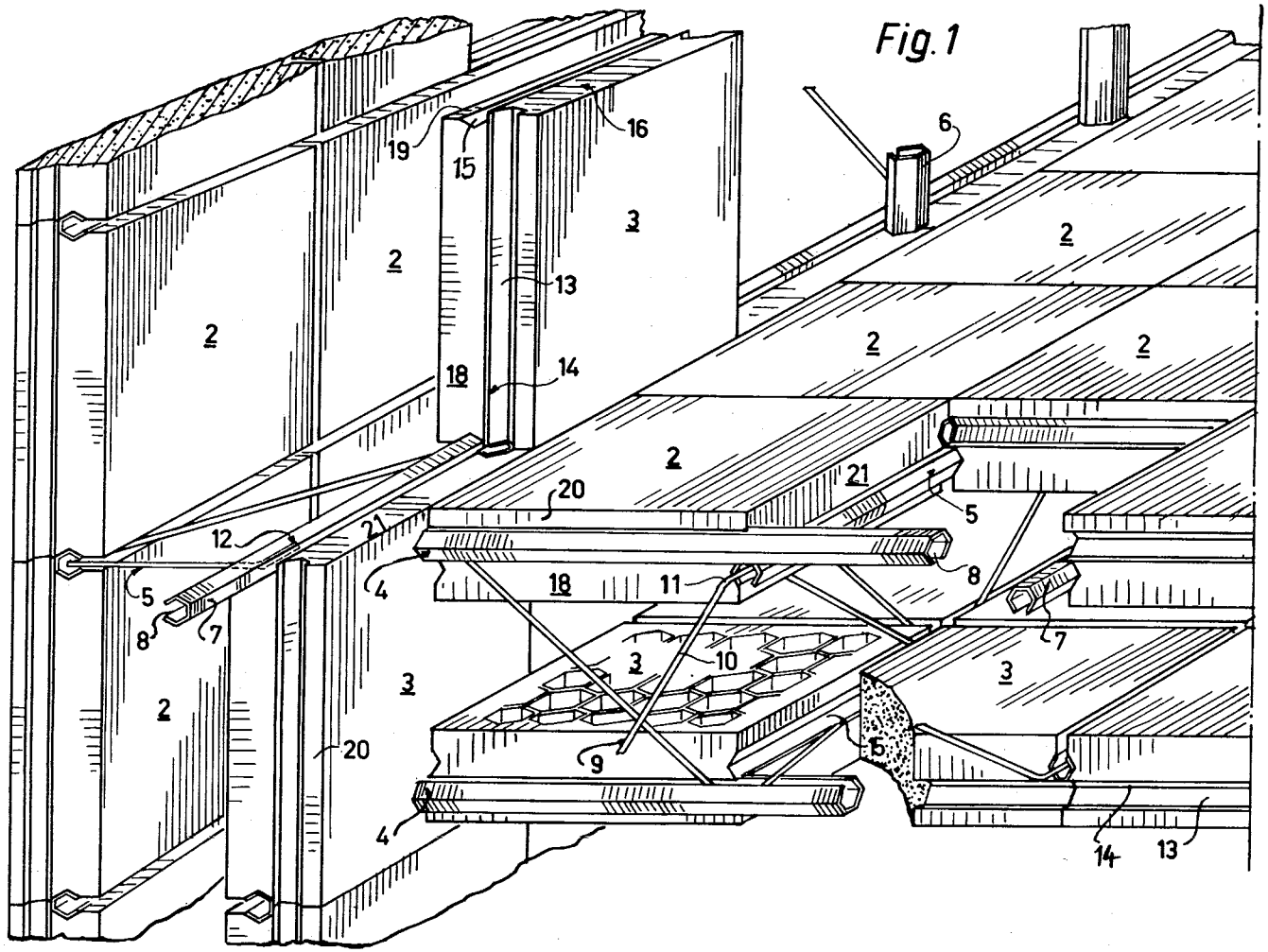
FIG. 1 is a perspective view, partially in section, of an exemplary embodiment of structure designed according to the teachings of the present invention.

Describing now the drawings the exemplary illustrated embodiment of structure possesses a girder or support grating 1 as well as building blocks 2, 3. The girder grating 1 consists of intersecting trusses or frame girders 4, 5. The first trusses, which extend in a first direction in parallelism with one another will be referred to hereinafter conveniently as the primary support. The trusses which are located at rignt angles to the first mentioned trusses and piercingly extend therethrough will be hereinafter conveniently referred to as the auxiliary supports. The trusses 4 and 5 can be continuous, that is to say, that they either can completely span a room to be covered or that they can span between the floor and the ceiling of the relevant room. Each of the trusses consists of two chords 6 and 7, wherein the first chord also will be referred to as the upper chord 6 and the other chord as the lower chord 7.

Each of the chords 6 and 7 is respectively constructed as a hexagonal profile rod having a groove 8 which is opened towards the inside of the rods 9 and simultaneously held in spaced relationship from one another, these connection rods extending alternately from the one to the other chord. In this way the connection rod 9 possesses diagonal portions 10 which extend between the chords 6 and 7 as well as flexed or bent portions 11 which are mounted and secured at the grooves 8 of the chords 6 and 7, for instance by being cemented in such chords.

At the end of the relevant truss or frame girder the portion of the connection rod 9 located between the chords 6 and 7 can extend perpendicular to the chords 6 and 7, and the ends 12 of the rod 9 are flexed back and likewise attached in the aforementioned manner in the groove 8. The ends of the truss must not however be closed off in this way.

In order that the auxiliary support 5 can be past through the main support 4 they are constructed to be lower than the main support 4. The height of the auxiliary support 5 corresponds to the inner spacing of the chords 6 and 7 of the main support 4.

The chords 6 and 7 of the trusses 4 and 5 engage in grooves which are formed at the end walls of the building blocks 2 and 3, specifically in such a way that always one-half of the chords possessing the hexagonal profile engage in one of the grooves in the end wall of two abutting building blocks.

By assembling together a number of supports and building blocks there is formed a structure having two forms which are arranged in spaced relationship from one another, and each of which consists of building blocks which abut one another by means of their end walls.

The building blocks can advantageously possess a square configuration in plan, but however they can also possess a different shape as required. In the illustrated exemplary embodiment there have been selected square building blocks which are fabricated for instance of gas concrete for the outer form of an outer wall. The length of the end wall for such building blocks in chosen such that three building blocks occupy a length of one meter. The building blocks are then 10 centimeters thick, and that face of the building blocks which confronts the interior of the structure is provided with blindhole bores in order to reduce as much as possible the inherent weight of the building blocks, the inside of such building blocks possessing the appearance of a honeycomb configuration. The outside of the building blocks of the outer form is smooth so that basically they do not require any post-processing. Yet, they can also be readily plastered or the like.

The building blocks of the inner form of the structure essentially possess the same plan configuration as the building blocks of the outer form, the thickness however can be selected to be smaller depending upon requirements, for instance if the inner form should form a ceiling- or wall covering. As material for such building blocks there can be employed plastic- or wood plates or boards, which are suitably worked or processed at their surface or can be differently colored.

Since the auxiliary supports 5 are guided to extend through the main supports 4 the intersecting and contacting chords of the trusses 4 and 5 are located in different planes. Accordingly, the grooves in the side walls of the building blocks 2 and 3 respectively must also be offset with respect to one another. The offsetting is undertaken such that the grooves 13 in one of the side walls 14 of one of the building blocks is offset by the height of the relevant chord 6 with respect to the groove 15 in that side wall 16 of the same building block which is located perpendicular to the first mentioned side wall 14.

Additionally, also the cross-section of the grooves 13 and 15 must be accommodated to the cross section of the chords 6 and 7 respectively. Since in the illustrated exemplary embodiment of the present invention there have been chosen chords with hexagonal profile, it is necessary that the relevant grooves 13 and 15 respectively possess a cross-section which corresponds to the shape of one-half of the hexagonal profile. After the individual building blocks have been assembled together into a brick work a chord always engages into the grooves of the neighboring closely situated and contacting building blocks, so that these two grooves completely surround the chords with the exception of a small joint.

As has already been explained the diagonal portions 10 of the connection rod 9 extend between the individual chords 6 and 7 of the relevant truss and therefore they must extend through the inner region 18 and 19 respectively of the side walls 14 and 16 respectively of two neighboring building blocks. For this purpose the inner regions 18 and 19 of the side walls 14 and 16 respectively of the building blocks 2 and 3 are equipped with recesses 17. The cross-section of such recesses 17 corresponds to one-half of the cross-section of the employed connection rod 9, and such recesses 17 are located at an angle to the axis of the groove 13 and 15 respectively formed at the same side wall of the building block, and which angle corresponds to the direction of the diagonal portion 19 of the connection rod 9. The position of recesses 17 with regard to the size of the building blocks 2 and 3 as well as the course of the connection rod 9 between the chords 6 and 7 is accommodated in each instance such that the flexed portion 11 of the connection rod 9 always extends through a joint location of two neighboring building blocks. In this way there is firstly reinforced the relevant chord at the relevant joint or contact location by the connection rod 9 and in particular it is possible that the auxiliary support can be readily extended through the main support.

The end walls 14 and 16 of the building blocks 2 and 3 further possess outer regions 20, 21 which are located closer to the outside of the building block than the previously discussed inner regions. The outer regions 20, 21 of the side walls of the building blocks are constructed without any recesses 17, so that the edges of the outside of the building blocks are linear. After assembling together such type structure the same only possesses small joints. The inner regions 18, 19 of a building block can also be constructed without recesses 17. They must then however be offset to a certain extent so that the diagonal portions 10 can loosely extend through between the inner regions 18, 19 of two abutting building blocks and can be easily introduced between such region.

With the previously described constructional embodiment of building block formed of gas concrete the groove is three centimeters wide. The outer and inner respective regions of the side wall is two centimeters and five centimeters wide respectively, wherein with the side walls of a building block disposed perpendicular to one another the statements concerning the width of the aforesiad regions are inversely applicable. During the erection of the described structure one proceeds as follows:

In the event one is concerned with a vertically arranged brick work then there is initially erected the vertically directed main supports and their lower ends are anchored at the building ground. Then there are laid the buildng blocks of the first layer of both forms of the structure and specifically between the relevant main supports. In so doing the building blocks are in each instance to be adjusted such that at firstly the outer regions of the side walls of the building block actually confront the outer side of the structure and secondly the grooves 15 of the building block which are closer to the inside of the brick work extend transversely between the relevant main supports. After all of the building blocks of the first layer have been laid then a first auxiliary support is pulled through the main support and laid over the already laid building blocks in such a way that its chords engage into the grooves 15 and its diagonally extending portions 10 into the recesses 17 in the building blocks 2, 3 of both forms of the structure. Then a second layer of building blocks which have been adjusted in the above-described manner are laid, which are covered with a further auxiliary support and so forth. Upon laying the buildng blocks between the main supports the flexible main supports can be bent away from one another to a certain degree in order to be able to more easily insert the blocks. Upon laying the building blocks in a horizontally arranged structure one proceeds in essentially the same manner. In this regard it is merely necessary to use a mounting framework from which the building blocks are laid in the support locality and which at the same time supports and secures the already finished portions of the structure prior to termination of the laying of the building blocks.

Figure 2:
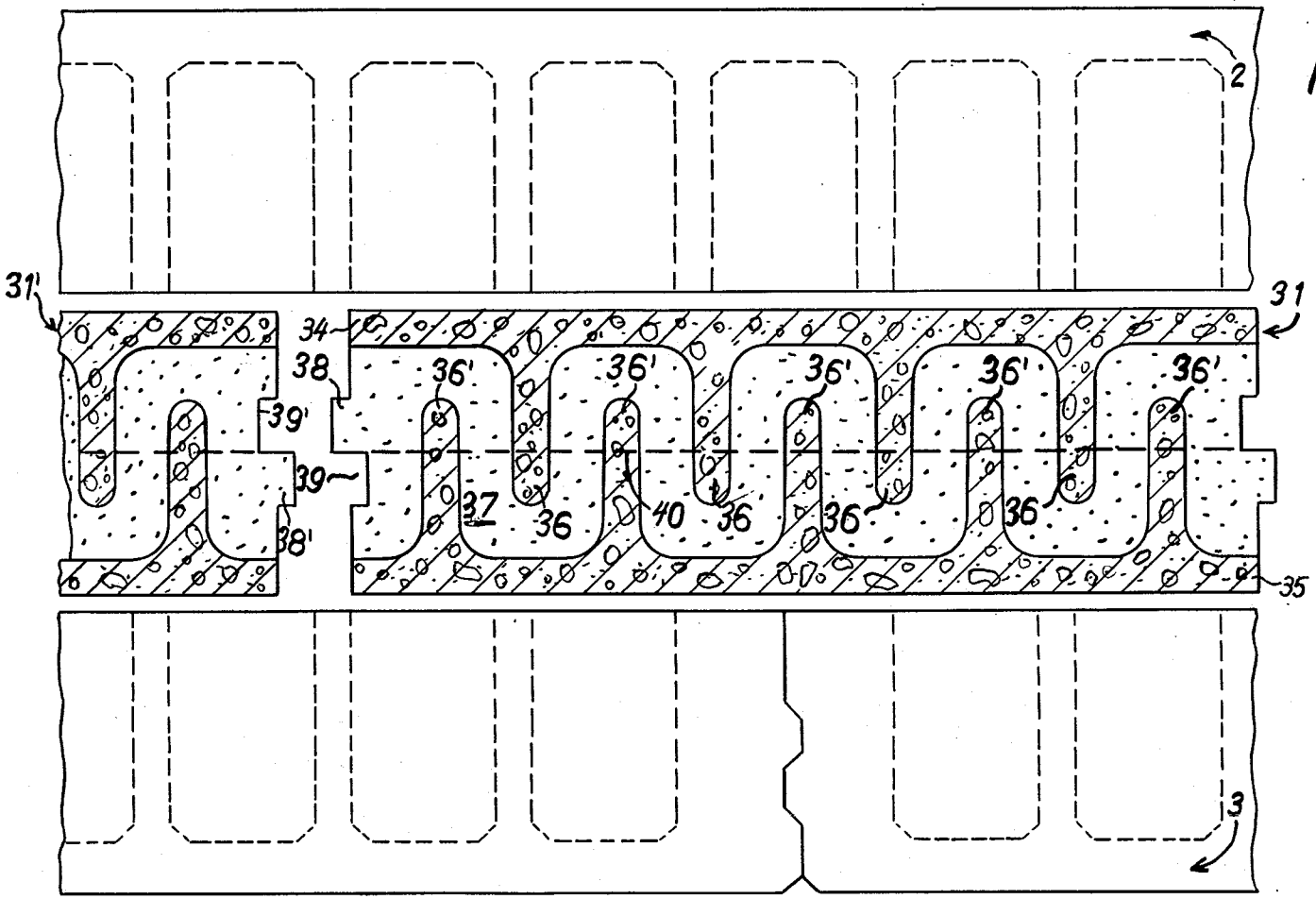
FIG. 2 illustrates an insulating block which can be arranged between the two forms of the structure of FIG. 1.
Figure 3:
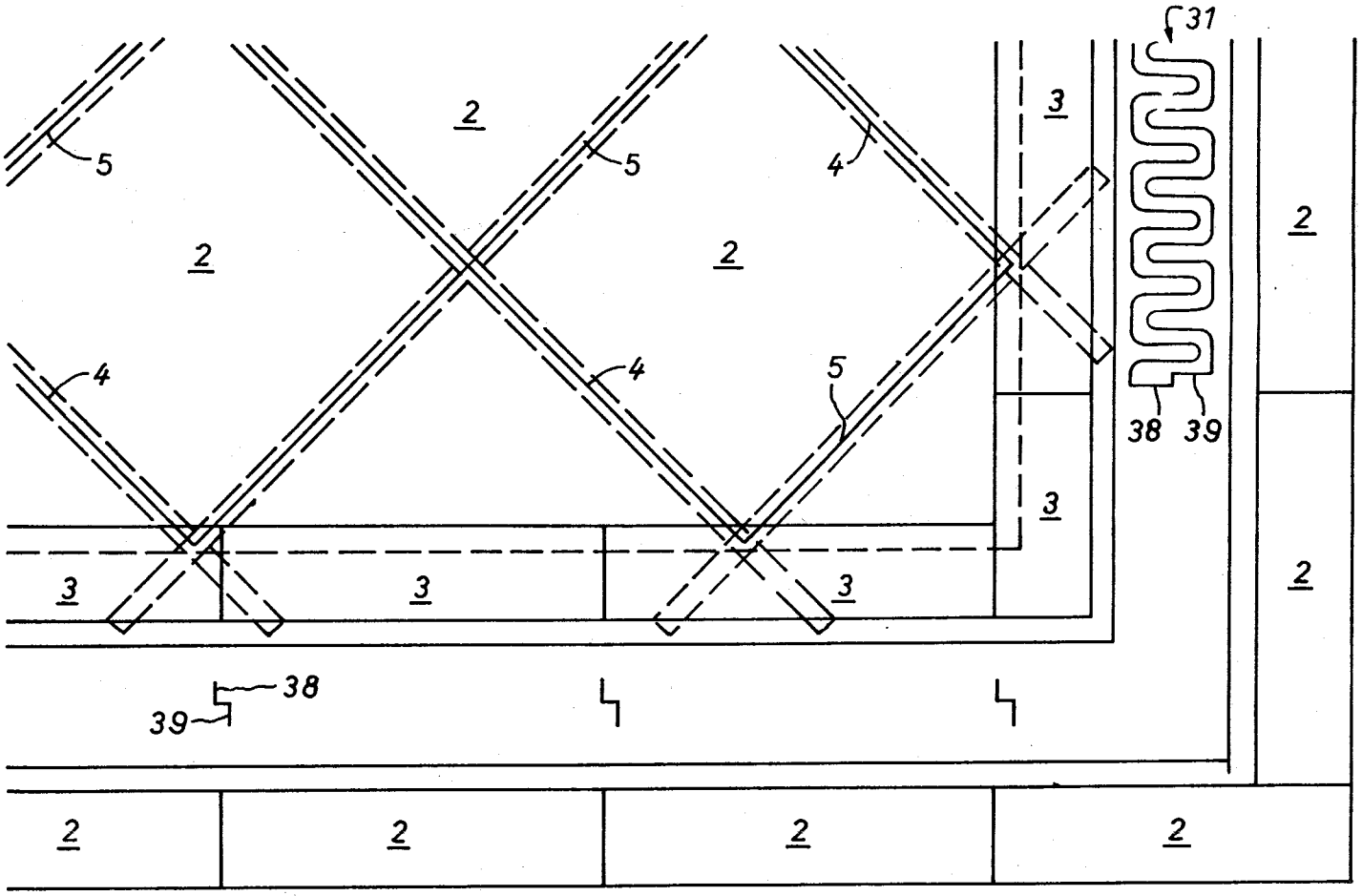
FIG. 3 illustrates supports of the structure of FIG. 1 which extend at an inclination with respect to the brick work or a terrain.

Between the building blocks 2 and 3 of the forms of the previously described structure there can be arranged an insulating layer of insulating blocks 31. An insulating block 31 suitable for this purpose has been depicted in FIG. 2.

The insulating block 31 possesses two components 34 and 35 formed of a load-carrying building material, for instance of mortar, concrete or the like, wherein in each case one side is profiled. Profiling of the aforementioned part of the load-carrying building material is formed by parrallel extending ribs 36 and 36' respectively which cover the entire one side of the relevant part 34 and 35 respectively. Both of the aforementioned parts 34 and 35 are arranged relative to one another in such a way that the ribs 36 of the first part 34 engage into the gaps between the ribs 36' and the second part 35. The insulating foamed material 37 which is located between the ribs 36 and 36' and the parts 34 and 35, which initially as the single use form forms the configuration for the ribs, possesses a meander shape.

The end surfaces of the insulating blocks 31 are provided with combs 38 and grooves 39. The combs 38 as well as the grooves 39 are formed at the end faces of the insulating block 31 in such a way that they always join together with grooves 39' and combs 38' of a neighboring insulating block 31'.

In order to realize the necessary compressive strength of the discussed insulating block 1 it is equipped with reinforcement 40, for instance round iron.

The notable advantage of this insulating block resides in the fact that the insulating body 37 consisting of foamed plastic material during the fabrication of the insulating block initially serves as the core form at which there are mounted the components 34, 35, advantageously first at the relevant building location.

POSSIBILITIES OF USE

The described structure can be employed for instance in the following situations: during the construction of industrial buildings or structures, offices, storage and exhibit halls, schools, kindergarten buildings, sport- and swimming halls, economical structures stalls- and riding halls, one -storey buildings, residential buildings and high rise buildings, children homes and old age homes, hospitals, sanitoriums and hotels as well as particularly during the construction of motels, garages, large garages and fire departments, and bridges, street overpass and underpasses and so forth as in the construction of tunnels.

Additionally, the structures can be used to build army depots which are employed in dense wooded areas.

As has already been discussed above the structure can be arranged both vertically as well as horizontally. The forms of the structure can extend parallel to one another, however they need not necessarily do so, for instance if one is concerned with a covering of a hall or a bridge construction.

For a flat roof structure or for the floor of a building there are employed trusses or frame girders with upper- and lower chords which extend parallel to one another and which extend from one support wall to the other support wall of the room or area to be covered.

In the case of a flat roof the joints at the outer forms can be also further covered with a plastic foil in order to obtain the requisite sealability or sealing of the roof. Additionally, there can be mounted at such type roof plates with grooves in which there can engage roof shingles or tiles. In the case of a floor of a multistorey building the outside of the building blocks of the upper form can be constructed as a floor flagstone or floor plate, so that it forms for instance a kitchen floor. It is however thereby necessary to seal the joints between the building blocks of the upper form by means of sealing profile members.

However, it is possible that a first group of trusses of the girder support grating only partially span the room or area to be covered. The remaining distance is then spanned by further trusses which belong to a second group of trusses and which extend parallel to the supports of the first group. Each of the trusses of the second group extends with one of its ends up to a point between the trusses of the first group. This so to speak overhang-type arrangement of main supports is possible because firstly the chords of the individual trusses engage into the grooves 13 of the building blocks 2, 3 which are distanced therefrom and are fixedly held at the chords and secondly, because the main supports 4 of both mentioned groups are connected with one another by the intersecting auxiliary supports 5, whereby the chords of the auxiliary supports 5 contact the chords of the main supports 4 and engage into the grooves 15 of the building blocks which they likewise hold in spaced relationship from one another.

The connection of the intermediate floor at on outside wall can be undertaken in such a way that at the height of the intermediate floor there is initially not laid a layer of building blocks of the inner form of the structure and the trusses are only supported at the already laid building blocks of such inner form. Hence the height of the relevant intermediate floor.

If the brick work is to be carried out in a vertical structure, then the trusses either completely span the height of the room or area to be enclosed or as previously described only partially span the same.

The first group of vertically arranged main supports which are supported at the ground and which are distanced from one another by more than a building block and extend parallel to one another, extends for the second just-mentioned situation only up to a height which is smaller than the prescribed total height of the wall. Only at a certain height above the ground of the all, however still below the upper end of the trusses of the first group, there begin the trusses of the second group which likewise are arranged parallel to one another but also to the trusses to the first group. A third group of vertical trusses can again be located between the trusses of the first and the second groups, naturally again offset by a certain height with respect thereto, and so forth.

These vertically extending main trusses of the aforementioned groups are then connected with one another by means of horizontally extending auxiliary supports, which likewise can extend through the brick work in this stepped manner.

The openings in the walls which are necessary for the installation of for instance windows or doors are formed in that the trusses at the region of such openings are simple not laid. Laterally of these openings the building blocks are merely held by the main supports and above and below such openings the building blocks are only supported by the auxiliary supports. If necessary, it is however possible to employ in this instance also shortened auxiliary- and main supports.

In the event that a brick work is to be erected for a cellar, then there are two possibilities for further constructing the double-form previously described structure.

If a mountain pressure is to be expected against the brick work, then there must be built a solid brick work. This can be realized in that in the intermediate spaces between the forms of the described structure there is poured-in concrete.

On the other hand, if a house is to be built at a downwardly slopint terrain and if there is to be expected the trickling through of the underground water into the celler, then there is mounted or assembled beneath the described brick work a run-off trough. The underground water then indeed does trickle through the outer form of the brick work, yet it flows however at the inner side of the outer form of the brick work into the run-off trough and then further, for instance, into the sanitation or sewage system.

In order to prevent the transfer of the trickled water up to the inner form of the brick work there can be selected a different course of the connection rods 9 at the main supports. The connection rod 9 can again possess diagonal as well as flexed portions, all of the diagonally extending portions of the connection rods however are located parallel to one another, whereby at the brick work they always extend downwardly from the inner form to the outer form. Thus water can flow along the diagonal portions of the connection rods from the standing trusses only from the inner to the outer forms.

As has already been mentioned the structure can also possess trusses with chords which are not in parallelism with one another. This can be for instance the case in the construction of halls where the supporting elements of the halls are constructed for instance as two joint frames. The supports carriers of such type employed frame is designed as a vertically arranged main support with non-parrallel chords. At the support carriers there then connects a horizontal or inclined main carrier. These two main carriers are connected with one another at the joints or knees of the upper and lower chords respectively, and specifically advantageously by means of the already discussed flexed portions 11 of their connection rods 9. Also in this case the offset and previously discussed construction of trusses can be employed.

Another field of application of the described structure is in the building of bridges. The support construction of such type bridge consists then of the main supports which span the distance to be bridged as well as the auxiliary supports which interconnect the main supports with one another. The upper chord of the main support in linear and after the building blocks in this case are laid they form together with the laid building blocks the roadway for the bridge. The lower supports of the main supports can be constructed to be arcuate and the auxiliary chords can possess different heights, depending upon where they are located at the main supports. The arcuate underside of the support construction can then likewise be filled with building blocks, which however are designed with bevelled end walls in order to be able to follow the bending of the lower chords of the main supports.

Of course it would be possible to construct in this manner also bridges of trusses in which the upper and lower chords extend parallel to one another.

The railings of such type bridges could also then be designed of main supports and auxiliary supports, the form of which corresponds to the form of the railings, whereby the space between the two forms of the railings can be covered for instance by means of a U-shaped sheet metal member.

The required trusses can be fabricated as the relevant building site from pre-fabricated profile members. To this end there is required a mold or form in which there is laid one of the hexagonal profile members, and specifically with the grooves 8 facing upwards. Then there is introduced into the groove the connection rod 9 with its flexed portions and over the oppositely siutated flexed portion 11 of the connection rod there is placed the other hexagonal profile member which forms the other chord. In the groove at the lower situated profile member there is cast concrete, the composition of which is chosen such that it rapidly hardens. Then the truss is tilted over such that the other chord comes to lie in the mold or form and its groove is likewise filled with concrete.

The hexagonal profile members can be formed of iron rods, but they can also be formed as rubber profile members. Prior to the insertion of the connection rods there must be introduced in each case at least one traction iron in such type chord. Such type constructed possess the advantage that they simultaneously can serve as the ceiling for the joints between neighboring building blocks.

If the required trusses are too long for the transport of the prefabricated profile members, then it is possible to unite or assemble together into a unit a number of finished trusses first at the building site, and specifically by means of the flexed portions of their connection rods.

ADVANTAGES OF THE STRUCTURE

The described structure possesses the following advantages.

A saving in time by virtue of the capability of carrying out rapid construction work, considerable saving in personnel as well as saving in electrical- and sanitation installation. Installations can be easily expended upon at any time. Partition walls can be easily shifted in this manner even by inexperienced people, disassembled and again erected, so that the described structure also is suitable for self building or as spare time and hobby work.

Enlarging of apartments as well as increasing the size of individual rooms and building of further storeys upon houses can be carried out quite easily, the changes can be carried out by using the already available materials. Owing to the building technique which is carried out without the use of mortar there is no waiting time, so that the structure can be immediately used after its erection.

Brick work which has become wet because of rain or snow dries rapidly. The structure possesses outstanding moisture insulation and does not exhibit any sucking-up of water. Good sound insulation can be attained through the use of suitable materials and the shape or form of the body of the building blocks, for instance by the sound-absorbing honeycomb-shape recesses. The brickwork assures for a good adherence as a noble plaster support as well as a color carrier, wallpaper carrier and so forth.

The building blocks of the structure can be fabricated in any length and used again at any time. There is not any scrap and there is no wear of the material. The building blocks can be previously painted or sprayed for use exclusively as provisional structures. The plastering of the blocks is not necessary. The blocks can be used as ceiling- and wall elements and the compressive strength can be determined and fabricated easily according to requirements. The building blocks ensure for an extremely reliable insulation. Inaccurate mounting of the insulation plates, such as negligent construction of the insulation pockets or spaces by the filling in of mortar is precluded. The building blocks for special fabricating techniques, when necessary, can be used in a number of hours. The building blocks can be used as visual- and decorative blocks and render possible the covering of facades by imitation plates.

For aesthetic reasons the blocks can be fabricated in dimensions of 4/9 $m^2$, 2/9 $m^2$ and 1/9 $m^2$. Furthermore, in structures (such as buildings, swimming- and sport halls, fabrication- and storage halls and so forth) there can be installed randomly equally formed glass building blocks; (plastic pourable resins) press pannel elements.

For the formation of air compartments the structure can be carried out as two- or three- wall or more walls. The combining of insulation and support blocks is exceedingly simple.

A slight heating up of the wall elements renders superfluous the usual heating elements or bodies. The structure through the provision of mounted air flaps, permits of a direct infeed of hot air into the rooms, and which can be opened and again closed as required, whereafter with the closed conditions the walls further indirectly transmit the necessary heat. This is especially useful for weekend homes. The wall forms an outstanding heat reservoir and there is insured for temperature compensation or balancing. It is easily possible to carry out ready replenishment of the air of the room by the blowing away of the ascending hot air and the supplementing thereof by cooling air by means of flaps provided at openings of the wall.

While there is shown and described present preferred embodiments of the invention, it is to be distinctly understood that the invention is not limited thereto but may be otherwise variously embodied and practiced within the scope of the following claims. Accordingly, What is claimed is:

1. A structure comprising building blocks lying together without being bound by motar, said building blocks having side walls with said side walls having grooves therein, chords of supports arranged in said grooves and located between said building blocks, said supports being truss girders including main and auxiliary supports with said auxiliary supports extending through said main supports, wherein the chords of a truss girder each comprise a hexagonal profile member, wherein the cross-section of said groove at said building block is bounded by one-half of said hexagonal profile member, the groove in one of said side walls of a building block being offset by the height of the related chord with respect to the groove in that side wall which is located perpendicular to the first-mentioned side wall.

2. The structure as defined in claim 1, wherein said chord of a truss girder has a groove opened toward the inside of said support, a connection rod extending between said chords of said truss girder and having flexed portions which are secured at the grooves of said chords opened toward the inside of said support.

3. The structure as defined in claim 2, wherein the connection rod at the end of the truss extends transversely between the chords thereof and its ends are flexed back.

4. The structure as defined in claim 1, wherein the outside of the building block is constructed as a floor flagstone or floor plate.

5. The structure as defined in claim 1, wherein the building blocks possess a substantially square configuration in plan view.

6. The structure as defined in claim 1, wherein two forms consisting of the building blocks are provided and a layer of insulating blocks is located between the two forms.

7. The structure as defined in claim 6, wherein one of the forms is constructed as a wall or ceiling covering.

8. The structure as defined in claim 6, wherein the inside of the building blocks possess the appearance of a honeycomb configuration.

9. The structure as defined in claim 1, wherein the interior of the chords is filled out with a material which holds the flexed or bent portions of the connection rod in the chords.

10. The structure as defined in claim 9, wherein said material is concrete.

11. The structure as defined in claim 1, wherein the building blocks are of glass.

12. The structure as defined in claim 1, wherein the chords are formed as rubber profile members.

13. The structure as defined in claim 1, wherein the building blocks serve as a heater.

14. A structure comprising building blocks lying together without being bound by mortar, said building blocks havng side walls with grooves therein, whereby the cross-section of said grooves at said building blocks is bounded by one-half of a hexagonal profile, chords of supports arranged in said grooves of said walls and located between said building blocks, whereby said supports being truss girders including main and auxiliary supports with said auxiliary supports extending through said main supports, wherein the chords of a truss girder each comprise a hexagonal profile and whereby said chord of a said truss girder has a groove opened toward the inside of said support, a connection rod extending uninterrupted between said chords of said truss girder and having flexed portions which are secured at the grooves of said chords opened toward the inside of said support, whereby the interior of the chords is filled out with a material which holds the flexed or bent portions of the connection rod in the chords, and whereby the groove in one of said side walls of a building block is offset by the height of the related chord with respect to the groove in that side wall which is located perpendicular to the first-mentioned side wall.

15. The structure as defined in claim 14, wherein said material is concrete.

* * * * *